US012781476B2

(12) United States Patent
Thompson

(10) Patent No.: US 12,781,476 B2
(45) **Date of Patent: *Nov. 3, 2026**

(54) AUTO-LEVEL AND DOWN-FORCE CONTROL IN A WORK MACHINE HAVING ARTICULATING ARMS

(71) Applicant: Caterpillar Inc., Peoria, IL (US)

(72) Inventor: Mark William Thompson, Cary, NC (US)

(73) Assignee: Caterpillar Inc., Peoria, IL (US)

( * ) Notice: Subject to any disclaimer, the term of this patent is extended or adjusted under 35 U.S.C. 154(b) by 119 days.

This patent is subject to a terminal disclaimer.

(21) Appl. No.: 18/375,435

(22) Filed: Sep. 29, 2023

(65) Prior Publication Data

US 2025/0109574 A1 Apr. 3, 2025

(51) Int. Cl.
*E02F 3/96* (2006.01)
*E02F 3/43* (2006.01)
(Continued)

(52) U.S. Cl.
CPC ..... *E02F 9/265* (2013.01); *E02F 3/436* (2013.01); *E02F 3/963* (2013.01); *E02F 9/2041* (2013.01)

(58) Field of Classification Search
None
See application file for complete search history.

(56) References Cited

U.S. PATENT DOCUMENTS 5,116,186 A * 5/1992 Hanamoto ..... E02F 3/437 37/348
5,826,666 A * 10/1998 Tozawa ..... E02F 3/437 172/7

(Continued)

FOREIGN PATENT DOCUMENTS

CN 111395425 A 7/2020
DE 102008010461 A1 8/2009

(Continued)

OTHER PUBLICATIONS

Written Opinion and International Search Report for Int'l. Patent Appln. No. PCT/US2024/042376, mailed Dec. 17, 2024 (14 pgs).

*Primary Examiner* — Rachid Bendidi
*Assistant Examiner* — Irene C Khuu

(57) ABSTRACT

A work machine, such as an excavator or a backhoe, has a linkage of articulating arms for maneuvering a changeable work tool. Position and motion sensors and force sensors within the linkage provide data for a controller to determine a location of the work tool and down force applied from the linkage onto the work tool during a job. Before performing a grading operation, an operator may request level control for the work tool at a benchmark orientation and down-force control at a target down force. After a controller applies the target down force with the work tool at the benchmark orientation, an operator may traverse the work tool along a path radial to the work machine. While maintaining the benchmark orientation for the work tool, the controller may adjust one or more forces on the linkage to also maintain the target down force during the traversal of the work tool, leading to simpler functionality for the operator and higher quality work product.

20 Claims, 7 Drawing Sheets

(51) Int. Cl.
*E02F 9/20* (2006.01)
*E02F 9/26* (2006.01)

(56) References Cited

U.S. PATENT DOCUMENTS

| | | | | |
|---|---|---|---|---|
| 5,975,214 | A * | 11/1999 | Okamura | E02F 3/437 37/414 |
| 9,765,499 | B2 | 9/2017 | Gorman et al. | |
| 9,856,625 | B2 | 1/2018 | Wada et al. | |
| 9,926,677 | B1 | 3/2018 | Beckhusen et al. | |
| 10,801,524 | B2 | 10/2020 | Nakano et al. | |
| 11,214,943 | B2 | 1/2022 | Yamanobe et al. | |
| 11,286,644 | B2 | 3/2022 | Maekawa et al. | |
| 11,293,163 | B2 | 4/2022 | Nogi et al. | |
| 11,293,169 | B2 | 4/2022 | Ueda et al. | |
| 2005/0132618 | A1* | 6/2005 | Koch | E02F 3/437 37/348 |
| 2006/0096137 | A1* | 5/2006 | Hendron | E02F 3/964 37/348 |
| 2008/0110647 | A1* | 5/2008 | Guo | A01B 59/069 172/1 |
| 2008/0169131 | A1* | 7/2008 | Takeda | G01G 19/083 177/136 |
| 2009/0056961 | A1* | 3/2009 | Gharsalli | E02F 3/844 172/779 |
| 2009/0159302 | A1* | 6/2009 | Koch | E02F 9/265 172/1 |
| 2010/0161185 | A1* | 6/2010 | Marathe | E02F 3/431 701/50 |
| 2012/0130599 | A1* | 5/2012 | Faivre | E02F 9/265 701/50 |
| 2012/0165962 | A1* | 6/2012 | Faivre | G05B 19/106 700/19 |
| 2012/0207576 | A1* | 8/2012 | Kraft | E02F 3/962 414/785 |
| 2012/0321425 | A1* | 12/2012 | Shatters | F15B 21/087 414/815 |
| 2012/0323451 | A1* | 12/2012 | Shatters | F15B 21/087 701/50 |
| 2014/0107897 | A1* | 4/2014 | Zhu | E02F 9/264 701/50 |
| 2014/0178164 | A1* | 6/2014 | Peterson | F15B 21/082 701/50 |
| 2015/0330057 | A1* | 11/2015 | Faivre | E02F 3/844 701/50 |
| 2016/0115669 | A1* | 4/2016 | Gorman | E02F 3/32 701/50 |
| 2017/0030048 | A1* | 2/2017 | Horton | E02F 3/3686 |
| 2017/0037594 | A1* | 2/2017 | Wada | E02F 3/43 |
| 2017/0191506 | A1* | 7/2017 | Lacher | F15B 13/0417 |
| 2018/0305890 | A1* | 10/2018 | Johansson | E02F 9/265 |
| 2018/0313063 | A1* | 11/2018 | Elkins | E02F 3/401 |
| 2019/0390436 | A1* | 12/2019 | Tanaka | E02F 3/437 |
| 2020/0011030 | A1* | 1/2020 | Nakano | E02F 9/2242 |
| 2020/0048861 | A1* | 2/2020 | Narikawa | E02F 9/20 |
| 2020/0232189 | A1* | 7/2020 | Yamanobe | E02F 9/26 |
| 2020/0256034 | A1 | 8/2020 | Yamamoto | |
| 2020/0325649 | A1* | 10/2020 | Tsukamoto | E02F 3/439 |
| 2020/0325650 | A1* | 10/2020 | Tsukamoto | E02F 9/205 |
| 2021/0079625 | A1* | 3/2021 | Narikawa | E02F 3/435 |
| 2021/0079626 | A1* | 3/2021 | Daimon | E02F 9/26 |
| 2021/0198868 | A1* | 7/2021 | Maekawa | E02F 9/265 |
| 2021/0301492 | A1* | 9/2021 | Nogi | E02F 9/2228 |
| 2023/0024622 | A1* | 1/2023 | Hoaby | E02F 3/436 |
| 2023/0183948 | A1 | 6/2023 | Noda et al. | |
| 2023/0349398 | A1* | 11/2023 | Zimmerman | E02F 9/264 |

FOREIGN PATENT DOCUMENTS

| | | | |
|---|---|---|---|
| DE | 102011002712 | A1 | 7/2012 |
| EP | 3666983 | A1 | 6/2020 |
| JP | H06346448 | A | 12/1994 |
| KR | 20140100167 | A | 8/2014 |

* cited by examiner

AUTO-LEVEL AND DOWN-FORCE CONTROL IN A WORK MACHINE HAVING ARTICULATING ARMS

TECHNICAL FIELD

The present disclosure relates to systems and methods for controlling a downward force on a work tool by articulating arms of a work machine. More specifically, the present disclosure relates to a work machine manipulating a work tool with a boom and stick and affecting operation of the work tool upon sensing that downward forces applied to the work tool are outside an acceptable range.

BACKGROUND

Some work machines such as excavators and backhoes contain a linkage of articulating arms for manipulating a work tool. The arms include a boom pivotally attached to the work machine and a stick pivotally joined between the boom and the work tool. Although a bucket or shovel is typically used, other work tools may be attached to the stick. These tools may include a breaker or hammer, a compactor, a mulcher, and similar devices.

Sensors and actuators associated with the arms can help control movement of the boom and stick during a job. For instance, motion sensors on the arms and pressure sensors in hydraulic cylinders that cause the arms to pivot may detect various forces within the linkage. Using data from these devices, a controller within the work machine may determine characteristics of the linkage during the job, such as a location of the work tool in space and forces applied on the linkage by the work tool and on the work tool by the linkage.

Typically, the sensors and actuators within the linkage help determine an upward force at the work tool caused by lifting of the linkage. For instance, when the work tool is a bucket, a controller within an excavator may use data from sensors and actuators within the linkage to calculate upward forces applied to the bucket holding a payload, such as dirt or rocks. As a result, the excavator can determine the weight of each scoop of payload as it is loaded into a truck. In other arrangements, sensors and actuators within the linkage may be used to ensure proper boom force during digging or leveling to help increase fuel efficiency and stability for the work machine.

In some situations, a work machine may evaluate a downward force from the linkage. One arrangement for using down force in an excavator is described in U.S. Pat. No. 11,293,163 ("the '163 patent"). The '163 patent describes a hydraulic drive apparatus in a work machine that automatically controls a pressing force of a bucket tip against a construction work surface while an operator guides the bucket along a path. The '163 patent notes that while the downward, or compaction, force at the bucket tip may be estimated from pressure within a hydraulic cylinder of the boom, that estimation may be inaccurate due to a posture of the linkage. Accordingly, the '163 patent describes a controller that receives a target pressing force, such as through a manual testing operation, considers a posture of the linkage, and adjusts a boom cylinder speed to correct the pressing force. Directed to an automatic system, however, the '163 patent does not address the variations in down force inherent in operation of the linkage by an operator or to tools other than a bucket tip. Nor does the '163 patent contemplate controlling down force to protect equipment or to restrain or otherwise guide an operator in successfully completing a job with the work tool.

Examples of the present disclosure are directed to overcoming deficiencies of such systems.

SUMMARY

In an aspect of the present disclosure, a computer-implemented method includes receiving, by an electronic controller within a work machine, a request for level control of a work tool attached to a linkage of the work machine, receiving a benchmark orientation for the work tool as part of the level control during a job, receiving a request for down-force control on the work tool, and receiving a target down force for the work tool as part of the down-force control during the job. The linkage includes a boom pivotally joined to the work machine and a stick pivotally joined to the boom, and the target down force is an amount of a force in a downward direction between the work tool and a work surface. The method further includes causing positioning of the work tool at the benchmark orientation and application of the target down force, receiving one or more signals requesting movement of at least the stick along a path, and causing movement of the stick. In addition, the method includes receiving sensor data indicative of forces in the stick and the boom during the movement, adjusting a position of the work tool to maintain the benchmark orientation, and calculating down force on the work tool during the movement. Upon determining that the down force differs from the target down force, the electronic controller adjusts one or more forces applied by the linkage to change the down force while maintaining the benchmark orientation.

In another aspect of the present disclosure, a control system within a work machine has one or more actuators positioned to impart forces on arms of the work machine, one or more sensors positioned within the arms, a memory, and a controller communicatively coupled to the one or more actuators, the one or more sensors, and the memory. The controller is configured to receive, from an operator interface within the work machine, a request for level control and a benchmark orientation for the work tool and a request for force control and a target down force for the work tool. The controller then causes the arms to apply the target down force on the work tool at the benchmark orientation, receives instructions to move the work tool along a path extending radially from the work machine, causes movement of the work tool along the path, and receives sensor data indicative of the forces on the arms during the movement. The controller is configured to adjust an angle of the work tool to maintain the benchmark orientation, calculate the down force on the work tool during the movement, determine that the down force on the work tool during the activity is different from the target down force, and, while maintaining the benchmark orientation, adjust at least one of the forces on the arms to change the down force.

In yet another aspect of the present disclosure, a work machine has a linkage including a boom pivotally interconnected with a stick, sensors configured to detect positions and forces within the boom and the stick, a work tool coupled to the stick, an operator interface configured to receive inputs for controlling the work machine and to display outputs relating to operation of the work machine, and an electronic controller communicatively coupled to at least the sensors and the operator interface. The electronic controller is configured to receive one or more commands to cause motion by the work tool along a path extending radially from the work machine as part of a job, cause the motion by the work tool along the path, receive sensor data indicative of forces on at least the boom and the stick during the motion, adjust a position of the work tool to have a level orientation, and calculate the down force on the work tool during the motion. Upon determining that the down force on the work tool during the motion is outside a down-force range, the electronic controller adjusts the down force on the work tool to be within the down-force range while adjusting the work tool to have the level orientation.

BRIEF DESCRIPTION OF DRAWINGS

The detailed description references the accompanying figures. In the figures, the left-most digit of a reference number identifies the figure in which the reference number first appears. The same reference numbers indicate similar or identical items.

DETAILED DESCRIPTION

Consistent with the principles of the present disclosure, a work machine, such as an excavator or a backhoe, has a linkage of articulating arms for maneuvering a changeable work tool. Position and motion sensors and force (or pressure) sensors within the linkage provide data for a controller to determine a location of the work tool and down force applied from the linkage onto the work tool during a job. Based on characteristics of the work tool, an acceptable range of down force applied by the linkage may be assigned. In some examples, if down force reaches an outer bound of the acceptable range during the job, the controller may generate an alert for the operator or adjust action by the work tool to maintain the down force within the acceptable range. Depending on the work tool and job, the down-force control can help improve work quality and guard against tool damage from dry-fire or overload conditions. In other examples, an operator may request level control for the work tool based on a benchmark orientation together with down-force control at a target down force. In this example, an operator may traverse the work tool along a path radial to or from the work machine, while the controller adjusts one or more forces on the linkage to maintain the benchmark orientation for the work tool and the target down pressure, leading to simpler functionality for the operator and more consistent work product. The following describes several examples for carrying out the principles of this disclosure.

Figure 1:
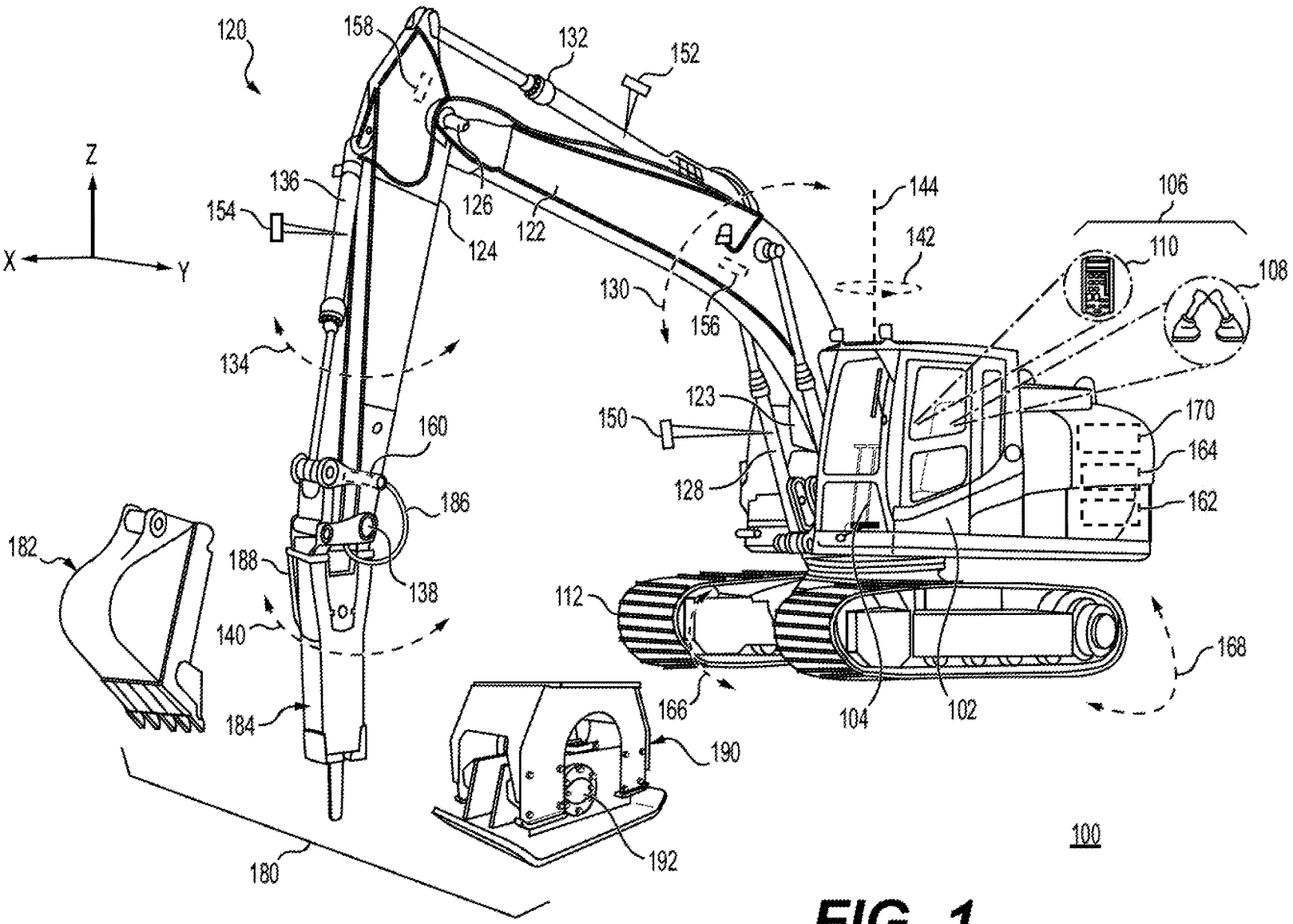
FIG. 1 is a perspective view of a representative excavator with changeable work tools for applying down force in accordance with an example of the present disclosure.

FIG. 1 illustrates an exemplary work machine 100 with various components and capabilities suitable for controlling down force on a work tool within the meaning of the present disclosure. As illustrated, work machine 100 is an excavator having a linkage 120 of articulating arms, although work machine 100 may be any other type of work machine having a similar structure, including a backhoe, a loader, or other earth-moving device. Work machine 100 typically operates within a work site to manipulate heavy objects or to act on the environment with high levels of force using a work tool 180.

A machine body 102 forms a base of work machine 100. The machine body 102 has a frame that houses a power source, or prime mover (not shown), various components and controls for causing physical action by machine body 102, and linkage 120 and for enabling electrical processing and communications by the machine. The power source may be any type of engine, such as an internal combustion engine, a diesel engine, a natural gas engine, a hybrid engine, an electric engine, or any combination thereof. The power source causes motion of machine body 102 along a ground surface by providing propulsion to undercarriage 112 and its affiliated traction devices, which may take any form, including wheels, tracks, and the like. Machine body 102 may include a cab 104 where an operator sits to command activity by work machine 100.

As noted above, work machine 100 includes linkage 120 for manipulating a work tool 180. Linkage 120 includes a boom 122 attached to machine body 102 at a pivot joint 123. The pivot joint 123 enables movement of the boom around a boom angle 130 at least partially in the vertical direction (i.e., in the X-Z plane in FIG. 1). Another arm of linkage 120, typically termed a stick 124, is rotatably attached to boom 122 via a pivot joint 126. The pivot joint 126 enables movement of the stick around a stick angle 134 relative to the position of boom 122 in the X-Z plane in FIG. 1. Finally, work machine 100 includes a work tool 180 coupled to stick 124 at a pivot joint 138, which enables movement of the work tool 180 around a tool angle 140 also along the Z axis in FIG. 1. As is well known in the field, the pivotal attachments of linkage 120, stick 124, and work tool 180 to each other enable various degrees of angular freedom in moving and otherwise applying forces to work tool 180 within the X-Z plane.

As generally illustrated in FIG. 1, different work tools may be installed onto the end of stick 124 and coupled to pivot joint 138. In some examples, stick 124 may include a quick coupler (not shown) at its end to enable rapid connection and disconnection of changeable work tool 180 with minimal operator intervention. Traditionally, a shovel or bucket 182 is attached and enables work machine 100 to dig or otherwise lift or move payload from one location to another. The bucket 182 may also be used for many other functions, such as compacting or scraping a surface, and is available in a variety of forms. In another example, work tool 180 may be a hydromechanical work tool, such as breaker or hammer 184, as shown installed on linkage 120 in FIG. 1. The hammer 184 contains a power source 188 that may be controlled by the operator via a hose 186. In some examples, when actuated by the operator, power source 188 causes rapid reciprocation of a piston, often through hydraulics, with high energy that may be imparted on a work surface akin to a jackhammer. In another example, a work tool 180 may be a vibratory plate compactor 190 used for increasing the density of a work surface. The vibratory plate compactor 190 includes a power source 192 that, when actuated by the operator via hose 186, causes vibration of its horizontal lower surface at high energy and a certain frequency, which may be imparted onto soil, for instance. These examples are not exclusive. Many other types of work tool 180 are available as attachments to linkage 120 and are suitable for use with the principles of the present disclosure, such as a fork arrangement, a blade, a ripper, a broom, a snow blower, a cutting device, a grasping device, or any other task-performing device known in the field.

To apply forces to work tool 180, each of boom 122, stick 124, and work tool 180 are movable by actuators. In some examples, the actuators are hydraulic actuators typically having a cylindrical body with a piston arranged to form two pressure chambers. The pressure chambers may be selectively supplied with pressurized fluid to cause the piston to be displaced within the cylinder, thereby changing the length of the hydraulic cylinder and extending or contracting the actuator. The flow rate of fluid into and out of the pressure chambers generally affects the speed of extension or retraction of the hydraulic cylinders, while a pressure differential between the two pressure chambers may relate to the force imparted by the actuator on a respective component of the linkage, i.e., boom 122, stick 124 or work tool 180.

In the example of FIG. 1, work machine 100 has three primary actuators. A boom actuator 128 may have one or more hydraulic chambers for extending or contracting the actuator in a piston action to move boom 122 about pivot joint 123. A stick actuator 132 may similarly include one or more hydraulic chambers for extending or contracting the actuator to move stick 124 around stick angle 134 at pivot joint 126, while a tool actuator 136 may include one or more hydraulic cylinders for extending or contracting work tool 180 about tool angle 140 at pivot joint 138. Although FIG. 1 illustrates hydraulic actuators, one or more of boom actuator 128, stick actuator 132, and tool actuator 136 may alternatively be electric actuators or motors, pneumatic motors, or any other actuation devices.

While boom actuator 128, stick actuator 132, and tool actuator 136 can cause movement of linkage 120 within the X-Z plane, a swing motor (not shown) within machine body 102 may enable rotation of linkage 120. The swing motor causes machine body 102 to rotate relative to undercarriage 112 about a swing axis 144, which extends substantially along the Z axis. As a result, the operator can cause machine body 102 and, thus, linkage 120 and work tool 180, to rotate about swing angle 142 in the X-Y plane in FIG. 1.

One or more sensors within linkage 120 and machine body 102 can provide data relating to physical parameters of work machine 100. The term "sensor" is meant to be used in its broadest sense to include one or more sensors and related components that may be associated with work machine 100 and that may cooperate to sense various functions, operations, and operating characteristics of the machine. The sensors may include one or more of a position sensor (e.g., a magnetometer, such as a Hall effect sensor, an anisotropic magnetoresistive (AMR) sensor, a giant magneto-resistive sensor (GMR), and/or the like), a location sensor (e.g., a global navigation satellite system (GNSS), including a global positioning system (GPS) receiver, a local positioning system (LPS) device (e.g., that uses triangulation, multilateration, etc.), and/or the like), an inertial sensor (e.g., an accelerometer and/or a gyroscope, such as an inertial micro-electro-mechanical systems (MEMS) device, a fiber optic gyroscope (FOG), or a similar type of device), and the like.

In some examples of sensors within work machine 100, boom actuator 128 can include a boom pressure sensor 150, stick actuator 132 can include a stick pressure sensor 152, and tool actuator 136 can include a tool pressure sensor 154. Each of these sensors may be a pressure gauge or a pressure transducer capable of detecting hydraulic pressure within one or more chambers of a respective hydraulic actuator. The detected pressure may be representative of forces applied to or on the respective arm of linkage 120. In some examples, the pressure sensors output a signal usable to determine a force created or experienced by the actuators and/or the arms in linkage 120. The forces together with the physical dimensions of the actuators and members of linkage 120 may be used to determine joint torques of at least boom 122 and stick 124. Alternatively, one or more of boom pressure sensor 150, stick pressure sensor 152, and tool pressure sensor 154 may be strain gauges, piezoelectric transducers, or other force sensing devices known to those in the field.

Other sensors within work machine 100 can provide data relating to the position and orientation of different parts of linkage 120 and machine body 102. As indicated in FIG. 1, boom 122 includes a boom inertial sensor 156 positioned within its frame. As boom 122 is raised or lowered about boom angle 130, boom inertial sensor 156 can detect its motion and location. In some examples, the boom inertial sensor 156 may be an inertial measurement unit (IMU) configured to sense and generate sensor data indicative of movement of boom 122, particularly linear acceleration and angular velocity. In some examples, the boom inertial sensor 156 detects at least six degrees of freedom (i.e., three translational movements and three rotational movements), such that the sensor data includes acceleration data indicative of the acceleration of boom 122 in three dimensions and angular velocity data indicative of the angular velocity of boom 122 in three dimensions. Boom inertial sensor 156 typically contains an accelerometer for generating acceleration data and a gyroscope for generating angular velocity data.

Similarly, a stick inertial sensor 158 may be included within stick 124, as generally indicated in FIG. 1. As with boom inertial sensor 156, stick inertial sensor 158 may also be an IMU that generates data indicative of movement of stick 124. Additionally, in some examples, a tool inertial sensor 160 is associated with movement of work tool 180 about pivot joint 138 along tool angle 140. The tool inertial sensor 160 may be an angular rotational sensor such as an anisotropic magneto-resistive (AMR) sensor, as known in the field. The tool inertial sensor 160 can sense when work tool 180 articulates about pivot joint 138 and generate sensor data indicative of those changes in position for work tool 180.

Within machine body 102, a swing sensor 162 can generate data representative of the angular or rotational position of machine body 102 within swing angle 142 at a point in time, while body inertial sensor 164 can indicate overall position, movement, and orientation of the machine. The swing sensor 162 may be associated with the generally horizontal swinging motion of machine body 102, and therefore work tool 180, imparted by the swing motor. In some examples, swing sensor 162 is a rotational position or speed sensor associated with the operation of the swing motor, an angular position or speed sensor associated with a pivot connection between machine body 102 and boom 122, or any other type of sensor known in the field for detecting a swing position of machine body 102 relative to boom 122. The body inertial sensor 164 may be an IMU that measures six degrees of freedom and provides position and attitude information of work machine 100. Among other data, body inertial sensor 164 provides data indicative of pitch 166 of the excavator between front and back (i.e., rotation in the X-Z plane in FIG. 1) and of roll 168 between left and right (i.e., rotation in the Y-Z plane in FIG. 1), in some examples.

Typically, within cab 104, an operator interface 106 provides tools for the operator to interact with and control activity by work machine 100, such as the movement of linkage 120 and/or machine body 102. For instance, operator interface 106 may include control sticks 108 to receive input from the operator for generating electronic instructions for performing a mission by command or for accessing preprogrammed features or missions in semi-autonomous behavior. As shown, operator interface 106 may also include a monitor 110 that can provide feedback and status information to the operator through one or more of an analog, digital, and/or touchscreen display. In some options, monitor 110 includes devices for the operator to provide input to the machine, such as through a keyboard, mouse, touchscreen, directional pad, selector buttons, or any other suitable features for recording manually entered data. In various examples, monitor 110 may also display one or more additional buttons, icons, and/or other controls operable to control various respective functions of work machine 100 as discussed below. In still further options, monitor 110 and/or other components of operator interface 106 may be configured to receive such inputs via voice recognition, gesture recognition, and/or other input methodologies. Accordingly, operator interface 106 permits the operator to learn about and monitor the performance of work machine 100 from information shown on a screen such as monitor 110, while possibly also interacting with control sticks 108 to affect behavior of the machine.

A controller 170, also known as an electronic control module or unit (ECM or ECU), provides centralized processing and control for work machine 100 in coordination with operator interface 106. The term "controller" is meant to be used in its broadest sense to include one or more controllers and/or microprocessors that may be associated with the work machine 100 and that may cooperate in controlling various functions and operations of the machine. The functionality of controller 170 may be implemented in hardware and/or software without regard to the functionality. Controller 170 may include or be coupled to a memory (not shown), which may store instructions or algorithms in the form of data, and a processing unit, which may be configured to perform operations based upon the instructions. The memory may be any suitable computer-accessible or non-transitory storage medium for storing computer program instructions, such as RAM, SDRAM, DDR SDRAM, RDRAM, SRAM, ROM, magnetic media, optical media and the like. The controller 170 may be a single controller or multiple controllers working together to perform a variety of tasks. Controller 170 may embody a single or multiple microprocessors, field programmable gate arrays (FPGAs), digital signal processors (DSPs), and/or other components configured to generate a compaction plan, one or more travel paths for work machine 100 and/or other information useful to an operator of work machine 100. Numerous commercially available microprocessors can be configured to perform the functions of controller 170. Various known circuits may be associated with controller 170, including power supply circuitry, signal-conditioning circuitry, actuator driver circuitry (i.e., circuitry powering solenoids, motors, or piezo actuators), and communication circuitry. In some examples, controller 170 may be positioned on work machine 100, while in other examples controller 170 may be positioned at an off-board location and/or remote location relative to work machine 100.

Figure 2:
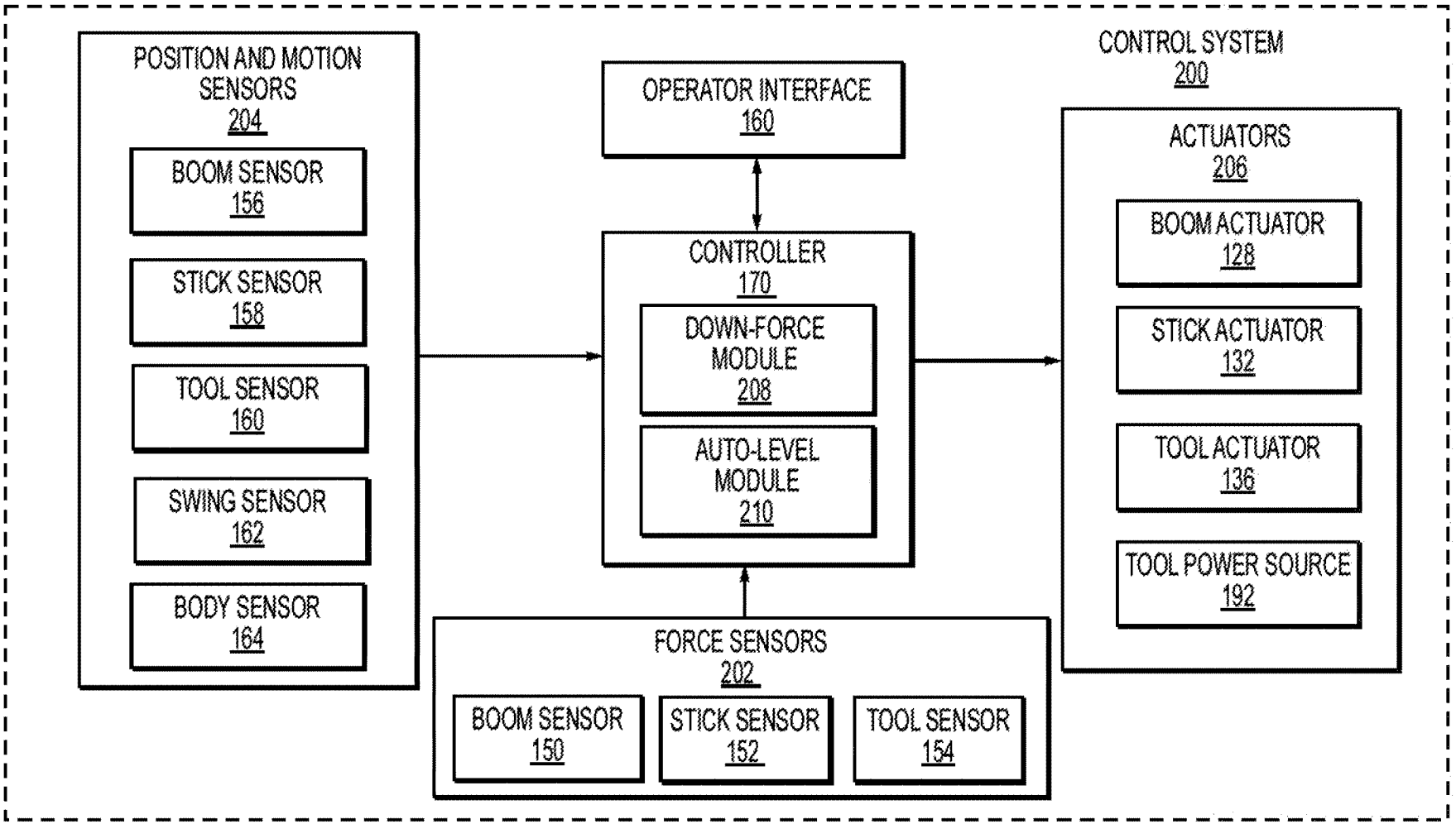
FIG. 2 is a functional block diagram of a control system within the excavator in FIG. 1 in accordance with an example of the present disclosure.

FIG. 2 is a generalized block diagram of a representative control system 200 based on operations performed by controller 170 for work machine 100. In some examples, controller 170 is configured to receive commands from an operator via operator interface 106, receive sensing data from the various sensors within work machine 100, such as pressure or force sensors 202 within linkage 120 and position and motion sensors 204 within linkage 120 and machine body 102, and process the commands and data to cause movement of linkage 120 and/or machine body 102. Movement may be effectuated by sending instructional signals to cause one or more of actuators 206 within linkage 120 and motors within machine body 102 to change position, whether in direct response to input from control sticks 108 or by following a preprogrammed mode of operation accessed and activated by the operator via monitor 110 or other portions of operator interface 106. Controller 170 may communicate with the one or more actuators 206 via a fluid circuit and delivery system, via electrical communication lines, or wirelessly. Cumulatively, as generally discussed below, the collection of data from sensors and delivery of signals to actuators enables work machine 100 to respond to the commands of an operator to apply forces and manipulate movement of work tool 180.

In accordance with the principles of the present disclosure, in some examples, controller 170, using one or more of position and motion sensors 204 and force sensors 202, may determine a down force applied to work tool 180 during an operation or job by work machine 100 and, using actuators 206, may regulate the down force within a predetermined range characteristic for the particular work tool 180 or the operation. Accordingly, controller 170 may function in a manner to essentially provide guardrails around the down force applied to work tool 180, ensuring that work quality is consistently high for the tool and job and protecting the tool from damage or degradation. In this context, "down force" generally means a force imparted by linkage 120 against work tool 180 substantially orthogonal to a work surface against which the tool is, or will be, in contact, such as along the −Z axis in FIG. 1. Down force does not need to be geometrically vertical with respect to work machine 100. For instance, if the work surface for a job is a hillside having a slope, machine body 102 may be on ground not parallel with the work surface, and linkage 120 may provide down force against work tool 180 into the sloped work surface other than along the −Z axis.

To determine and regulate the down force within a predetermined range, controller 170 may have a down-force module 208 to execute the required functions. A module refers to hardware, software, or combinations of hardware and software configured to store and execute computer-readable instructions for a particular task. Thus, a module within controller 170 may be assigned to a certain processor and memory, to instructions within memory alone, or to dedicated hardware implementations for carrying out the applicable tasks. In general, the results of executed instructions by controller 170 following software within down-force module 208 is communicated to actuators 206 to control operation of linkage 120 within the predetermined range of down force in the manner discussed below.

Figure 3:
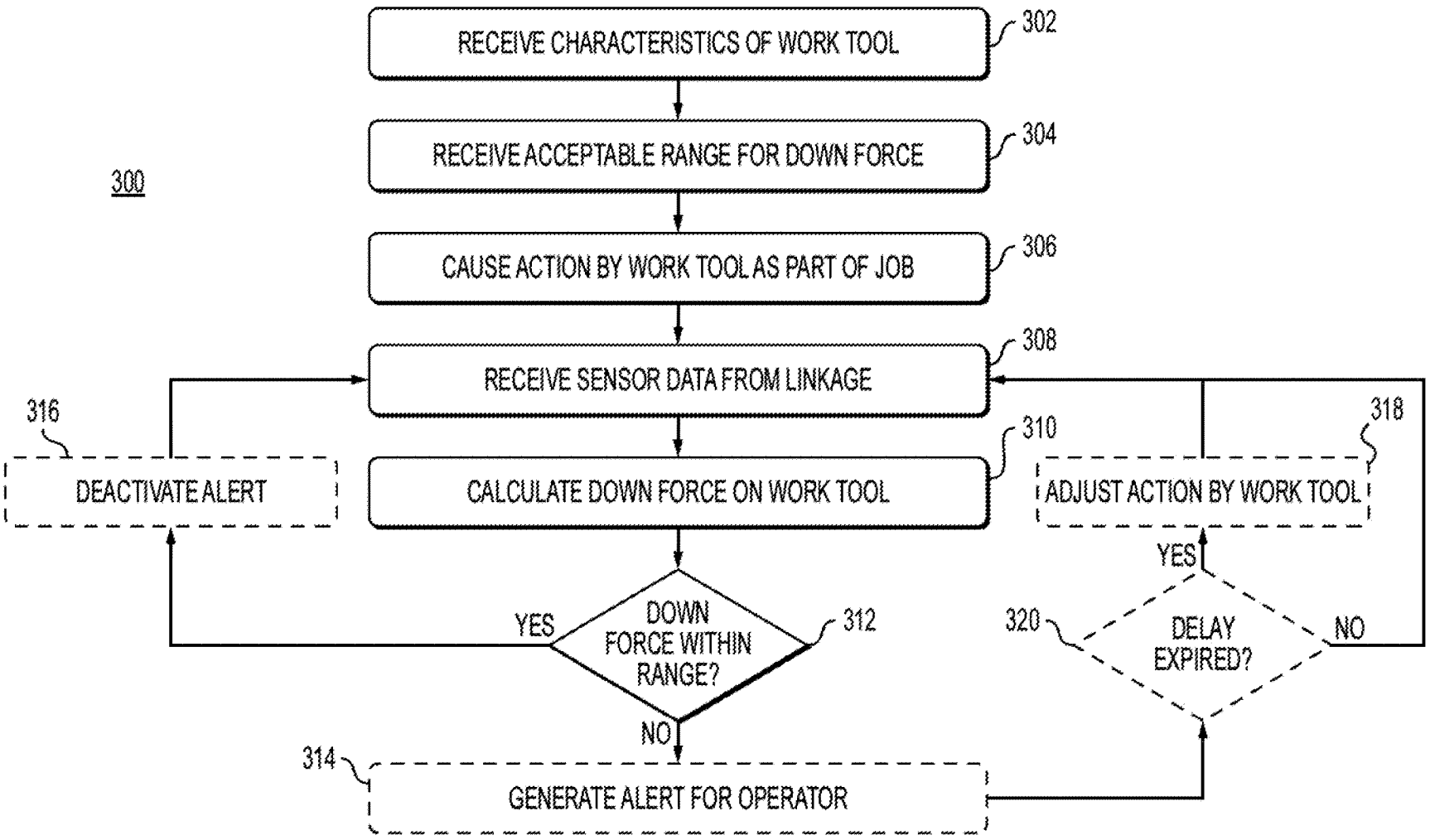
FIG. 3 is a flowchart depicting a method of regulating down force within a range by the excavator in FIG. 1 in accordance with an example of the present disclosure.

FIG. 3 is a flowchart of a representative method 300 executed by controller 170 of control system 200 for controlling down force in work machine 100 of FIG. 1. This method 300 is illustrated as a logical flow graph, operation of which represents a sequence of operations that can be implemented in hardware, software, or a combination thereof. In the context of software, the operations represent computer-executable instructions stored on one or more computer-readable storage media that, when executed by one or more processors, perform the recited operations. Generally, computer-executable instructions include routines, programs, objects, components, data structures, and the like that perform particular functions or implement particular data types. The order in which the operations are described is not intended to be construed as a limitation, and any number of the described operations may be combined in any order and/or in parallel to implement the process. Steps that are contingent or optional have shapes with dashed lines as borders.

Generally depicted as 300 in FIG. 3, the method begins with a step 302 of receiving tool data indicative of characteristics for a work tool attached to a linkage of the work machine. In this step, an operator sitting in cab 104 may interact with operator interface 106 to indicate which of many potential work tools is attached to stick 124, possibly from options provided on monitor 110 for the operator. Alternatively, the work tool 180 may contain one or more devices (not shown) capable of communicating or otherwise indicating its identity and/or characteristics to controller 170. In some examples, these devices may have capabilities for communicating within a short range using Bluetooth or near-field communications, for example, and being identified within operator interface 106 or elsewhere by controller 170. Other options, such as scannable bar codes, QR codes, resonant tags, and similar technologies, may also provide techniques for identifying the work tool associated with linkage 120 in work machine 100. In some examples, memory within or associated with controller 170 stores information relating to the type and characteristics of the identified work tool. For example, the memory may identify the type of work tool as a hammer, such as hammer 184 shown in FIG. 1, along with characteristics for that hammer, such as dimensions, weight, power, or other pertinent data for the device. In other options, operator interface 106 may be configured so that the characteristics of the work tool may be entered directly into controller 170, such as by using monitor 110.

In a second step 304, controller 170 receives force data indicative of an acceptable range for down force delivered by the linkage of the work machine on the work tool during a job. As expressed above, in this context down force refers to a force delivered from the work machine, i.e., from linkage 120, in a downward direction between work tool 180 and a work surface. The work surface may be the ground, a substance such as concrete or rocks, vegetation, or any other material for which the work machine may be employed.

The pressure data may be received by controller 170 in many ways, such as by having the operator enter the job and pertinent data via control sticks 108, such as by choosing from options presented on monitor 110 for the operator. In one example, the operator could enter the job as compacting an area of ground, the work tool as vibratory plate compactor 190, and the acceptable range of down force on vibratory plate compactor 190 during the job. In some examples, the operator selects the acceptable range of down force based on experience, the conditions of the job, or any other parameters. Alternatively, the acceptable range of down force may be predetermined and loaded into memory to be accessed by controller 170 upon receiving data about the job and the specific work tool to be used. In some examples, data representing a range of down force may be a minimum value and a maximum value. In other examples, such as discussed further below, the range of down force may be represented by a single value.

Following receipt of an acceptable range for down force, controller 170 causes action by the work tool as part of the job, as indicated by step 306 in FIG. 3, in response to input from the operator. It is generally envisioned that movement or action of the work tool happens at least in part under manual control of the operator by way of operator interface 106, as opposed to autonomous operation of work machine 100 programmed into controller 170. The input from the operator may include providing direction through one or more signals via operator interface 106 to request action by the work tool during the job. Specifically, the operator could manipulate control sticks 108 to direct work machine 100 to move linkage 120 accordingly. In response, down-force module 208 may command one or more of actuators 206 to cause linkage 120, and therefore work tool 180, to move. Alternatively, or additionally, action by the work tool may include work machine 100 actuating a motor or other power source within a work tool, such as power source 188 in hammer 184 or power source 192 in vibratory plate compactor 190, to cause vibration or other motion by the tool.

In step 308, down-force module 208 within controller 170 receives sensor data from one or more sensors within the linkage of the work machine indicative of forces on at least the boom during the action by the work tool. In particular, one or more of force sensors 202 can provide data representative of forces imparted on work tool 180 by the boom and the stick. In a known manner, boom pressure sensor 150 and tool pressure sensor 154 may detect hydraulic pressure within boom actuator 128 and tool actuator 136, respectively, and may convey that data to controller 170. Controller 170 may in turn interpret or translate that sensor data as information indicative of forces in the boom and stick as movement of linkage 120 occurs.

Having received the sensor data regarding forces in the boom and stick, controller 170 may then calculate the down force on the work tool, as shown by step 310 in FIG. 3. Calculating forces at any point within linkage 120, including on work tool 180, involves consideration of many factors within work machine 100 in addition to the sensor data, as is known to those of ordinary skill in the field. For example, controller 170 may consider the dimensions and weight of each component within linkage 120, as well as a center of gravity for each of boom 122 and stick 124. That machine data may be stored in memory of controller 170 or alternatively entered into controller 170 via operator interface 106. The weight and orientation of work tool 180 may also be considered in light of information discussed for that device in step 302. Also, the various angles and motion of boom 122 and stick 124 may be derived from data provided by boom inertial sensor 156, stick inertial sensor 158, swing sensor 162, and body inertial sensor 164. Applying mathematics known to those of ordinary skill in the field to the geometric arrangement of linkage 120 and work tool 180, controller 170 determines down force applied to work tool 180 at points in time during the job.

In step 312, controller 170 compares the calculated down force with the stored acceptable range for down force to determine whether the down force on the work tool during the action is within the range. Considering the example provided above for compaction of a work surface, an acceptable range of down force on vibratory plate compactor 190 as predetermined and stored or entered into memory via operator interface 106 may be between 70 kN and 100 kN, for instance. If the down force calculated in step 310 were 85 kN, controller 170 would find that value to be an optimal level within the acceptable range and would take no action on the operator's control of vibratory plate compactor 190.

Thus, as shown in FIG. 3, method 300 would return to step 308 where controller 170 would continue to receive sensor data from the linkage as the compaction job continues.

On the other hand, if controller 170 calculates a down force of 50 kN at step 310, for instance, controller 170 would conclude at step 312 that the down force on vibratory plate compactor 190 is outside the acceptable range. In that event, at least the consistency and quality of the compaction job may be in jeopardy. As a result, controller 170 will generate an alert (step 314), typically within monitor 110 or within cab 104. The alert may be an icon or other visual aspect on monitor 110, for example, an audible warning within cab 104, a haptic response, or any other form of communication to reach the attention of the operator. Alternatively, the alert may be generated for notifying an entity other than the operator, such as a portion of control system 200 that may oversee operation of machine 100 in a semi-autonomous mode. Following generation of the alert, down-force module 208 of controller 170 may return to step 308 where down-force module 208 would continue to receive sensor data from the linkage as the compaction job continues and to calculate down force on the work tool (step 310). If a condition changes such that the calculated down force falls within the stored acceptable range of down force, down-force module 208 may cause the alert to be deactivated (step 316, contingent on an alert having been activated). Going forward, assuming the calculated down force remains within the acceptable range, down-force module 208 would repeatedly receive sensor data from force sensors 202 in the linkage (step 308), calculate down force on work tool 180 (step 310), and compare the down force with the acceptable range (step 312).

In some examples, in addition to, or possibly alternatively to, generating an alert for the operator (step 314), method 300 includes having down-force module 208 cause an adjustment to the action by the work tool to affect the down force on the work tool (step 318, optional). Therefore, if the down force on work tool 180 calculated at step 310 were higher than an outer bound or limit of the acceptable range for down force, down-force module 208 of controller 170 may cause boom 122 or another portion of linkage 120 to move higher vertically, i.e., substantially in the direction of the Z axis in FIG. 1. The result of this movement should decrease the force from linkage 120 on work tool 180, lowering the down force. Among other means, down-force module 208 could cause boom 122 to move vertically by sending a command to have the pressure system add fluid to an appropriate chamber within boom actuator 128, moving a piston and extending boom actuator 128 to lift boom 122 upward orthogonally away from the work surface. Conversely, if the down force on work tool 180 calculated at step 310 were lower than an outer bound or limit of the acceptable range for down force, down-force module 208 of controller 170 may cause boom 122 to move lower orthogonally against the work surface to increase the down force. Whether down force is too high or too low with respect to the acceptable range, method 300 may continue receiving sensor data (step 308), calculating down force (step 310), and adjusting the boom position (optional step 318) until the down force is corrected into the acceptable range, as shown in FIG. 3.

Accordingly, method 300 provides a routine for work machine 100 to essentially include a form of protective guardrails on the down force applied to work tool 180 by an operator. In one example as discussed, a compacting job or operation using vibratory plate compactor 190 with an acceptable range for down force according to method 300 can help ensure consistency and quality for the compaction. If the operator controls linkage 120 such that the down force becomes too high, i.e., about an upper bound of an acceptable range, down-force module 208 may trigger an alert to have the operator adjust the force. Optionally, as shown in FIG. 3, method 300 could include a time delay between activation of the alert in step 314 and any adjustment of the action by the work tool in step 318. Thus, the alert notifies the operator to take action to return the down force to an acceptable level and if the operator does not act before the time delay expires (step 320), down-force module 208 can automatically force adjustment of the down force by changing position of boom 122 (step 318), providing an additional guide for manual operation of the work tool. As another alternative, controller 170 could be figured to adjust the action of the work tool (step 318) without first providing an alert to the operator (step 314). Controller 170 could also be configured to prevent the down force from exceeding a predetermined limit by inhibiting the linkage from moving into a position that causes that excess (either down force being too high or too low). Method 300 contemplates the performance of any one or more of causing an alert (step 314), waiting for the passage of time (step 320), and adjusting action by the work tool (step 318), and performance of any of these steps in any sequence.

In another example, method 300 may be employed for a mulcher (not shown) as work tool 180. Mulchers are typically used in land and vegetation clearing and in the forestry industry. With a mulcher, high values of down force may decrease performance and increase potential damage of the work tool. If the down force exceeds a predetermined maximum, the feed rate for the tool (i.e., the rate at which material is fed into the moving blades of the mulcher) may be too high, causing the blades to stall, decreasing work efficiency. As well, too high of a down force may damage the mulcher when the high feed rate places strain on the equipment. If the down force is below a predetermined minimum during a job, the mulcher may be wasting energy and time that could be applied to cut more efficiency. Accordingly, following method 300, a controller 170 for a mulcher may better regulate the amount of down force linkage 120 applies, generating an alert for the operator when the down force approaches or reaches an end range (step 314) and/or adjusting action by the mulcher (step 318) so that operation of the tool remains within the acceptable range for down force.

In a different example, the method 300 executing on work machine 100 may also be applied to protect vibratory plate compactor 190 and similar equipment from damage due to the down force being too low. Dry firing, or blank firing, in the context of work tools is an operating condition in which a vibrating or reciprocating work tool is allowed to run without being in contact with a work surface. For instance, a hammer, such as hammer 184, and a compactor, such as vibratory plate compactor 190, when actuated by work machine 100 will be driven locally within the work tool by power source 188 and power source 192 respectively to cause the tool to reciprocate or oscillate with high energy. When the tool is not engaged sufficiently against a work surface, this high energy will be absorbed by the work tool and not transferred to the work surface as intended. Consequently, the absorbed energy may lead to premature degradation or failure of the work tool.

Consistent with the principles of the present disclosure, method 300 may be applied to avoid dry firing due to down force on work tool 180 being too low. Thus, in step 304, controller 170 may receive an acceptable range of down forces in the form of a minimum required down force, which may be a single value. The operator interface 106 may be configured to receive input relative to only this minimum down force amount or input indicating that dry-fire protection is the condition of interest for the attached work tool from which a predetermined value for the work tool may be accessed from memory. As a result, the acceptable range for down force then essentially extends from the minimum down force amount and upwards, possibly to a very high value.

In the following steps for dry-fire protection, method 300 proceeds similarly as discussed above when used to achieve consistent work quality, such as with compaction. In the next step 306 for dry-fire protection, down-force module 208, typically through commands received via operator interface 106, causes action by the work tool by actuating the vibration, reciprocation, or other local movement within the work tool. In some examples, action on the work tool would entail activating power source 188 in hammer 184 or power source 192 in vibratory plate compactor 190. In steps 308, 310, and 312, down-force module 208 assesses the down force applied to work tool 180 during the job. If the operator has not engaged the work tool sufficiently against the work surface, then the calculated down force (step 310) will indicate that the down force is below the stored minimum down force from step 304, and an alert may be generated for the operator (step 314).

Additionally, down-force module 208 in some situations may be configured to cause adjustment to the position of boom 122 or other component within linkage 120 (step 318) to increase the down force against the work tool until the down force rises above the entered minimum down force. In some examples, rather than adjusting the position of boom 122 in step 318, down-force module 208 is configured in that step to cause the action of the work tool, i.e., vibration, reciprocation, or other action by a local power source, to decrease or cease. Thereafter, 300 continues through its steps until the down force is within the acceptable range (i.e., greater than or equal to the entered minimum). At this point after success at step 312, method 300 may include a step (not shown) as, with step 306, to re-actuate the work tool.

Figure 4:
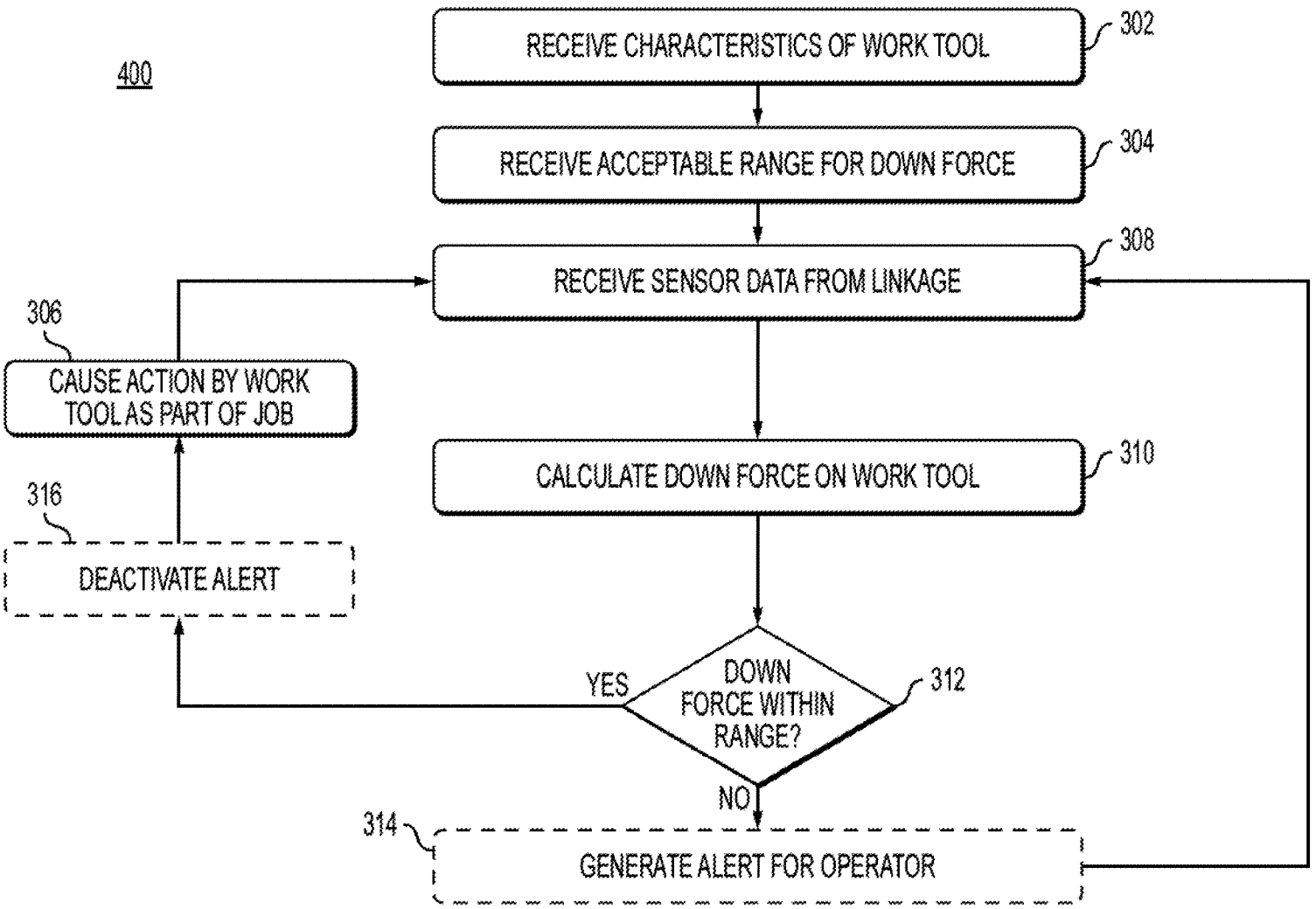
FIG. 4 is a flowchart depicting a method of starting a work job to avoid a dry-fire condition for a work tool in accordance with an example of the present disclosure.

Similarly, in an alternative for dry-fire protection, FIG. 4 provides a method 400 as a variation of method 300 for tool startup, such that work machine 100 ensures that sufficient down force exists before actuating work tool 180. In some examples, causing action by the work tool (step 306) by activating its power source in FIG. 3 may be changed in FIG. 4 to occur after down-force module 208 concludes that the down force on the work tool is within the acceptable range (step 312), i.e., greater than or equal to the designated minimum value. In this sequence, controller 170 will help guard against starting up a vibrating or reciprocating work tool before the tool is adequately pressed against a work surface. Accordingly, when applied for dry-fire protection, method 300 may help an operator avoid conditions in which an energized work tool is not sufficiently positioned to deliver its high energy to a work surface and is at risk of damaging itself.

In another example, method 300 in FIG. 3 may also be applied to guard against overloading of work tool 180 due to down force being too high and possibly for too long, which may lead to increased wear and premature failure of the tool. Most any work tool may be susceptible to overloading, including bucket 182, hammer 184, and vibratory plate compactor 190. In this example, in step 304 of method 300, controller 170 may receive an acceptable range of down forces in the form of a maximum allowable down force, which may be a single value. The operator interface 106 may be configured to receive input relative to only this maximum down force amount or input indicating that overload protection is the condition of interest for the attached work tool, from which a predetermined value for the work tool may be accessed from memory. As a result, the acceptable range for down force may essentially extend from the maximum down force amount and downwards, possibly to zero.

In the following steps for overload protection, method 300 proceeds similarly as discussed above for FIG. 3 when used to achieve consistent work quality, such as with compaction. Because a deviation from the maximum down force amount may not be an immediate concern for overload protection, down-force module 208 in some examples is configured to include an optional time period for which the down force exceeds the maximum amount before corrective action is taken. Specifically, following a conclusion in step 312 that the calculated down force is not within the acceptable range due to being greater than or equal to the entered maximum amount, controller 170 may start a timer to delay corrective action for a predetermined time period. Thus, after concluding that the down force is not within range, method 300 may cycle through steps 312, 308, and 310 until the time period elapses, after which down-force module 208 can generate an alert for the operator (step 314) or adjust the boom position (318). In other examples, method 300 may entail generating an alert (step 314) after the calculated down force is not within the acceptable range (step 312), and waiting until the time period elapses before adjusting the boom position (step 318). Other variations to the sequence of method 300 are contemplated and within the knowledge and experimentation of those of ordinary skill in the field. Therefore, following method 300 for overload protection, work machine 100 can help protect against wear and other damage to work tools due to excessive down force applied by linkage 120 at least during manual operation. It will be apparent that the equipment discussed is exemplary only and that other work tools may also benefit from the arrangement and methods described for regulating down force to improve work quality and avoid damage to equipment.

In accordance with the principles of the present disclosure, down-force control may also be combined with other automated activities by controller 170, such as auto-leveling of the work tool. In some situations, a job may require extension and contraction of stick 124 about pivot joint 126 to traverse a substantially linear path (possibly without swing of machine body 102) while treating a work surface or moving a payload. Work tools for these activities may include vibratory plate compactor 190, a vibratory drum compactor (not shown), a compaction wheel (not shown), a mulcher (not shown), pallet forks (FIG. 6) and similar excavator attachments. As the linkage moves the work tool from extension to contraction (e.g., along the −X axis in FIG. 1) or vice versa, boom 122 may be substantially stationary as stick 124 pivots radially about pivot joint 126 along stick angle 134. With this radial movement, stick 124 does not follow a level path along the X-Y plane, making it a challenge for an operator to maintain the angle of the work tool at a constant position during the movement. For instance, while mulching brush or lifting payload, the work tool may begin at a preferred angle to the ground surface for accomplishing the task, such as with the tool being substantially orthogonal to the ground surface and the lower surface of the tool being substantially parallel with the ground surface. As the linkage moves the work tool from extension to contraction (or vice versa), maintaining a fixed position at pivot joint 138 between the work tool and stick 124, for example, may cause the lower surface of the work tool to lose its levelness with the ground surface. As discussed below, controller 170 may be configured to adjust the articulating arms of linkage 120 to keep the work tool level (i.e., at a fixed angle or slope during the contraction or extension of linkage 120) while performing variations of method 300, which can further help an operator attain high work quality.

Figure 5:
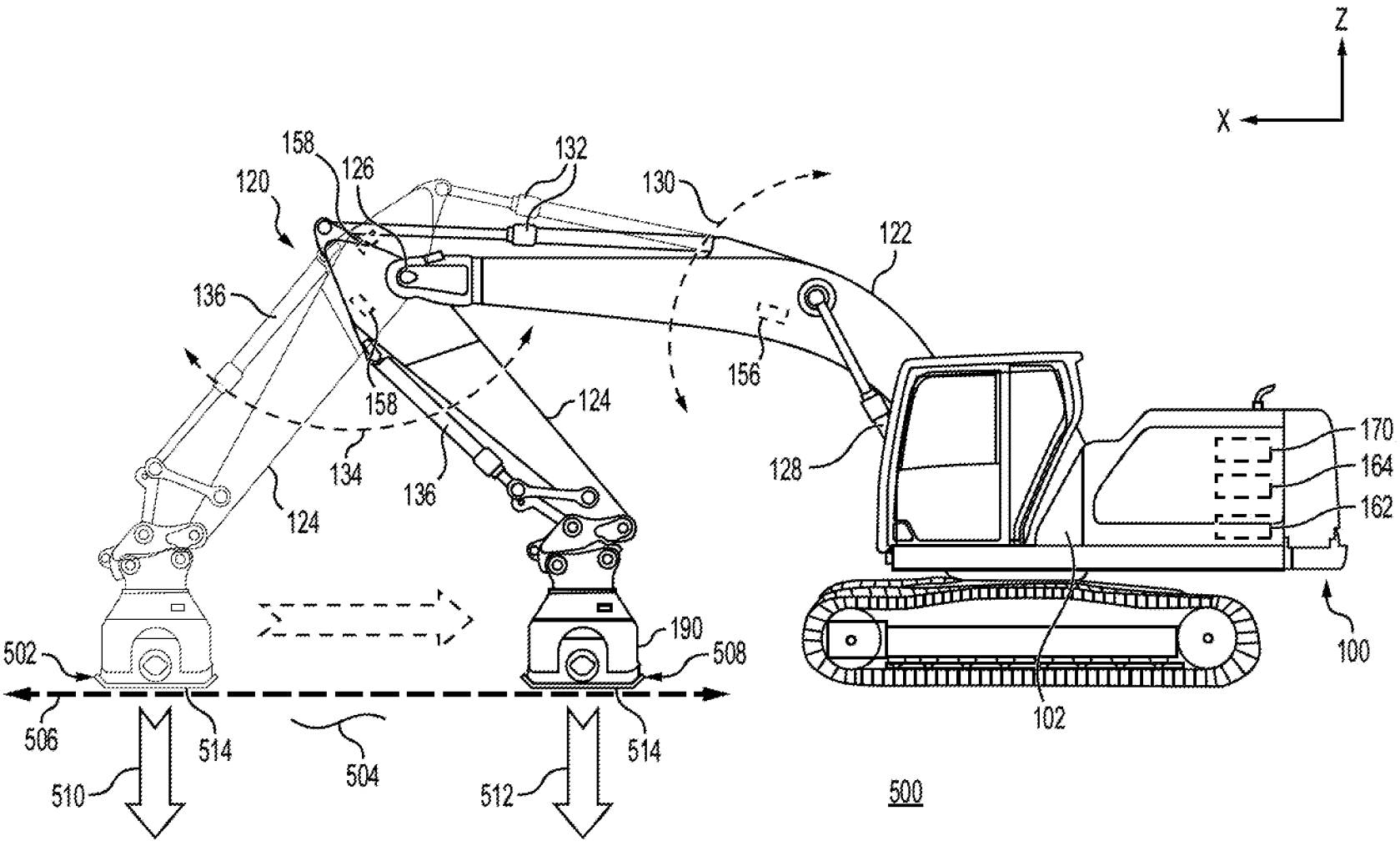
FIG. 5 is a side view of a representative excavator operating with level control and down-force control during movement of a compactor in accordance with an example of the present disclosure.

To help illustrate auto-leveling, FIG. 5 is a side view 500 of an excavator moving a vibratory plate compactor between extension and contraction of the linkage as the work tool passes along the −X axis. As illustrated, the representative work tool is vibratory plate compactor 190, which begins at first position 502 on work surface 504 and moves along a substantially level path 506 to reach a second position 508. At first position 502, underside 514 of the work tool is substantially parallel with level path 506 against which first down force 510 is substantially orthogonal. Without adjustment by linkage 120, vibratory plate compactor 190 would essentially travel in a slight arc along stick angle 134 to reach second position 508, causing underside 514 of the vibratory plate compactor to angle away from level path 506 and providing inconsistent contact with work surface 504. In accordance with the principles of the present disclosure, when activated with a level-control mode, controller 170 may be configured to adjust the length of one or more of boom actuator 128, stick actuator 132, and tool actuator 136 during the movement between first position 502 and second position 508 to keep vibratory plate compactor 190 at the same angle with respect to work surface 504 during movement along level path 506. In addition, when down-force control is activated, controller 170 may be configured to adjust the length and forces within one or more of boom actuator 128, stick actuator 132, and tool actuator 136 during the movement between first position 502 and second position 508 to keep first down force 510 and second down force 512 substantially equal, such as illustrated in FIGS. 3 and 4. The combination of this level-control and down-force control may enable consistent and quality compaction on work surface 504 while easing the tasks for the operator. Other work tools may similarly benefit from combined auto-level control and down-force control in a like manner.

Figure 6:
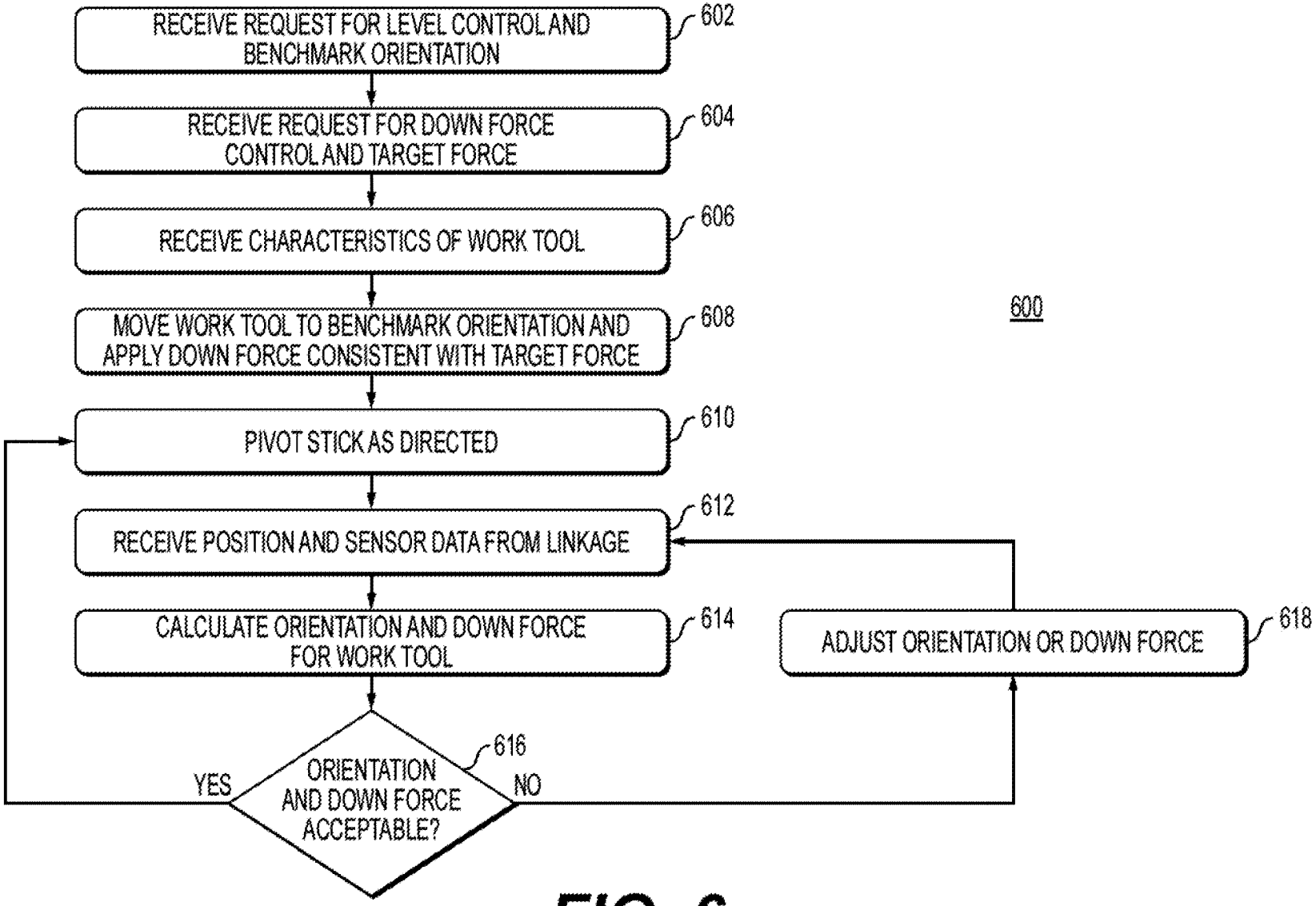
FIG. 6 is a flowchart depicting a method of applying level control and down-force control on the excavator in FIG. 5 in accordance with an example of the present disclosure.
Figure 7:
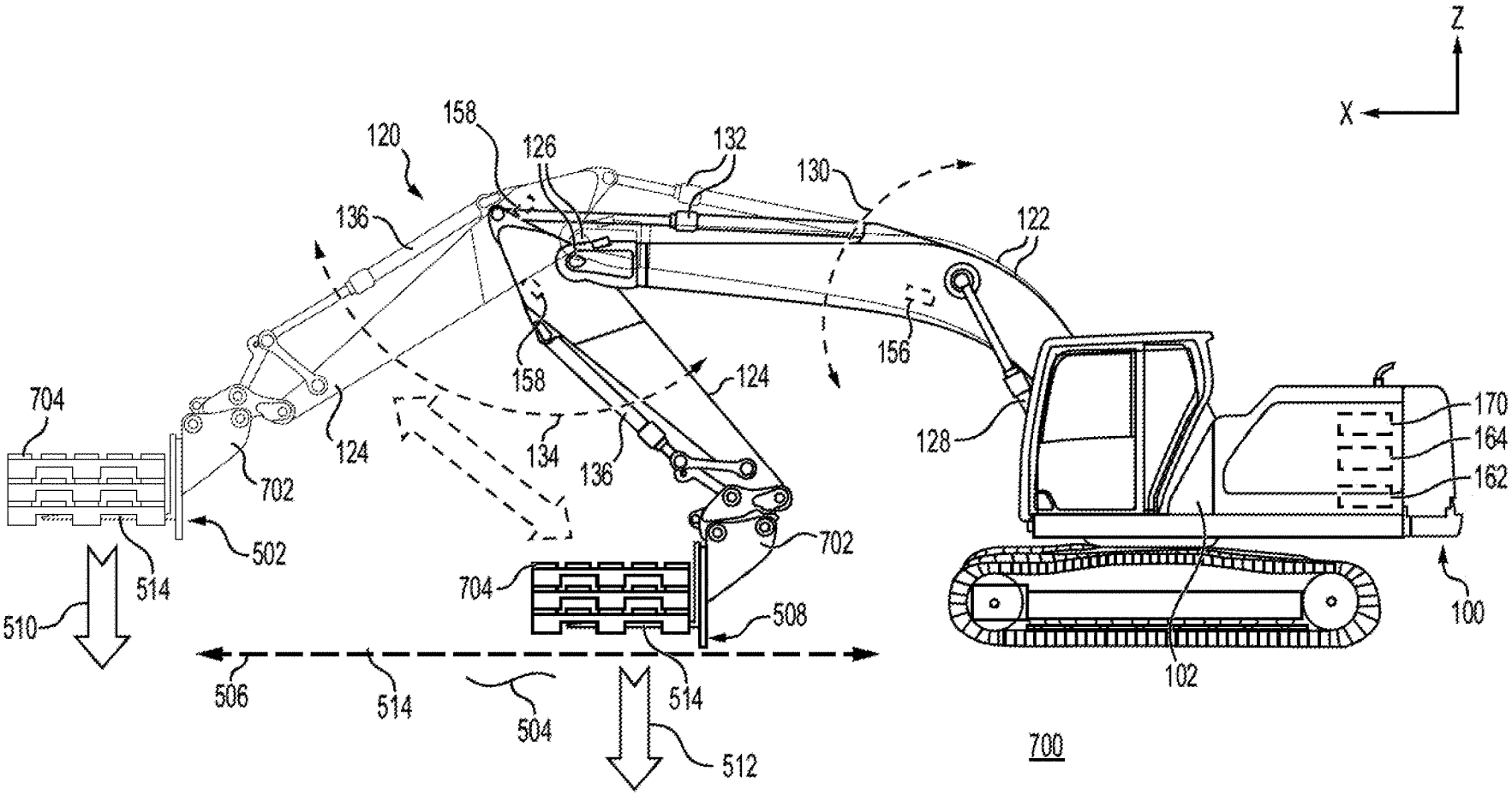
FIG. 7 is a side view of the representative excavator of FIG. 5 operating with level control and down-force control during movement of pallet forks in accordance with an example of the present disclosure.

FIG. 6 is a flowchart of a representative method 600 executed by controller 170 of control system 200 for controlling leveling and down force in a work tool, while FIG. 7 is another example of work machine 100 operating according to method 600. Turning to FIG. 7 first, work machine 100 is illustrated with pallet forks 702 as the changeable work tool 180. In contrast to vibratory plate compactor 190, pallet forks 702 are typically useful for lifting and lowering a payload, such as pallets 704, rather than applying pressure onto the surface of ground. Therefore, linkage 120 may be initially configured to hold pallets 704 in a level position to avoid their spilling from tines or forks within pallet forks 702. As linkage 120 travels between extension and contraction and pivots around stick angle 134, keeping tool angle 120 constant may cause pallet forks 702 to become angled relative to level path 506, causing pallets 704 to fall from pallet forks 702. As a result, tool angle 120 may need to be adjusted as linkage 120 is lowered or lifted while being contracted or extended to avoid spillage. Moreover, as with the examples discussed above in the context of method 300 relating to excessive down force leading to tool damage, the tines of pallet forks 702 may not be capable of withstanding the full down force that work machine 100 can produce. Therefore, a combination of auto-level control to avoid spillage from pallet forks 702 and down-force control to avoid damage to the tines of pallet forks 702 can provide increased performance and ease of operation for work machine 100. While FIG. 7 illustrates an example for pallet forks 702, other work tools such as bucket 182 and a mulcher could also benefit from the combined auto-level control and down-force control.

Turning to the flowchart of FIG. 6, in some examples, a method 600 of controlling down force while automatically leveling the work tool begins with an auto-level module 210 within controller 170 receiving and accessing data relating to the operation to be performed. Through operator interface 106, an operator can select or otherwise indicate the desire to perform an auto-leveling operation, which is received by controller 170 in step 602. As part of that indication, controller 170 may further receive a benchmark orientation or angle (e.g., relative to a work surface 504 such as the X-Y plane) at which the work tool should be leveled. The benchmark orientation may be received through operator interface 106 or may be set by controller 170 based on the orientation of linkage 120 at a particular time. For instance, at the outset of an auto-leveling operation, the operator may position the work tool at the desired orientation to the work surface 504 and actuate a command via operator interface 106 to set or store the current orientation of the work tool as the benchmark orientation. Before or after this data entry, auto-level module 210 may also receive a request for down force control and a target force for the down force (step 604). In some examples, the target force is a range of acceptable down forces on the work tool. In other examples, the target force is a single value at which it is desired that linkage 120 will apply force on the work tool, such as may be the case for vibratory plate compactor in the example of FIG. 5. In yet other examples, the target force is a single value as a maximum force that linkage 120 will apply to the work tool, such as may be the case for pallet forks 702 in the example of FIG. 7. Further, in step 606, as in step 302 in FIG. 3, auto-level module 210 may receive data indicative of characteristics of the work tool attached to work machine 100, which in the example of FIG. 5 is vibratory plate compactor 190 and in FIG. 7 are pallet forks 702. This data, such as dimensions and weight, may be entered by an operator through operator interface 106 or, in other options, may be stored in memory and retrieved upon identification of the applicable work tool by the operator or, as discussed above, by the work tool itself through wireless communication.

Following this receipt of data by auto-level module 210, method 600 proceeds to step 608 where auto-level module 210 coordinates movement of the work tool to the benchmark orientation, if not already in that position, and application of a down force on the work tool consistent with the targeted downward force. In general, movement of the work tool to the benchmark orientation with respect to FIG. 5 involves changing the length of one or more of boom actuator 128, stick actuator 132, and tool actuator 136 to position vibratory plate compactor 190 in contact with first position 502 based on input from the various position and motion sensors 204. In some options, controller 170 may place vibratory plate compactor 190 at this initial position in response to direction received from the operator via operator interface 106. The work machine 100 may apply a first down force 510 on the work tool by lowering boom 122 and calculating, based on input from the various force sensors 202, the resulting downward force. The target force may be equal to a single value or within a range of values as entered into operator interface 106 or otherwise received by down-force module 208. For the example of FIG. 7, similar activities may be followed to position pallet forks 702 at the desired orientation relative to work surface 504 for first position 502, although an initial application of a down force on the work tool need not occur based on the work task to be performed.

In step 610, positioning of the work tool becomes controlled by the operator. The operator may manipulate control sticks 108 to cause contraction or extension of linkage 120, which will involve pivoting of stick 124 about pivot joint 126. As this pivoting occurs, down-force module 208 receives position data from position and motion sensors 204 and sensor data from force sensors 202 within linkage 120 (step 612), from which the orientation and down force on vibratory plate compactor 190 or pallet forks 702 may be calculated. In step 614, the calculated orientation and down force are compared with the target values or ranges for those parameters to determine if the calculated amounts are acceptable. In some examples, the orientation or angle for the work tool and the applied down force are calculated and compared with stored values essentially continuously as movement of linkage 120 occurs. If the orientation and down force remain within acceptable values (i.e., substantially equal to a preset value or within a range of preset values), down-force module 208 will continue to pivot stick 124 as directed by the operator (step 610).

On the other hand, if either the orientation or down force for vibratory plate compactor 190 (FIG. 5) or pallet forks 702 (FIG. 7) is not commensurate with preset values, down-force module 208 at step 618 will adjust the length of one or more of boom actuator 128, stick actuator 132, and tool actuator 136 to adjust the down force or the orientation, or angle, of the work tool. Thus, if the orientation of vibratory plate compactor 190 or pallet forks 702 with respect to a work surface such as ground is outside preset values, which may occur at one of the ends of the extension or contraction of stick 124, auto-level module 210 may cause the work tool to rotate about tool angle 140, changing its position to align with first position 502. Changes to other positions of linkage 120, such as movement about one or more of boom angle 130, stick angle 134, and tool angle 140 may also be performed by auto-level module 210 to keep an orientation of work tool 180 consistent during contraction and extension of the linkage. This change in orientation for work tool 180 will ensure continued compliance with the auto-leveling operation. Likewise, if the down force on vibratory plate compactor 190 is calculated to be outside preset values, down-force module 208 may raise or lower boom 122 to adjust the down force on work tool 180, whether through automatic adjustment or through action by the operator. The cycle of moving or pivoting stick 124 (step 610), receiving data and calculating orientation and down force (steps 612 and 614), and making any adjustments to orientation or down force (steps 616 and 618) can repeat essentially continuously until the operator has stopped moving stick 124 and work tool 180 has reached second position 508 with a second down force 512.

Different work tools and operations may also be used to perform method 600 with auto-leveling and down-force control. For instance, a mulcher being used to clear vegetation at a fixed height above the ground may benefit from method 600. Setting a target down force as an acceptable range for controller 170 can enable an operator to manipulate linkage 120 at an optimal feed rate with down-force control and at a predetermined orientation with respect to a work surface 504 with auto-leveling. Similarly, with bucket 182, an operator could effectively perform scraping of a work surface with auto-leveling and down-force control. In this example, the benchmark orientation may be such that the bucket 182 is angled for effective scraping by the teeth on the bucket near or at the top of the work surface, while the target down force is applied to perform the scraping without damaging the work surface for excessive downward force.

Those of ordinary skill in the field will appreciate that the principles of this disclosure are not limited to the specific examples discussed or illustrated in the figures. For example, while a work machine with selected attachments has been disclosed, the principles of the present disclosure are applicable to any variety of attachable work tools for use with a linkage on a work machine. Also, it will be appreciated that data used by the machine controller, such as the identity and characteristics of a work tool, the desired down force value or range, and the desired tool orientation and slope, may be entered via the operator interface, these values may be stored in memory within the machine or communicated to the controller through other means convenient for the implementation. Moreover, while the present disclosure addresses work machines having a boom and a stick, machines having different arrangements of support arms for a work tool could also benefit from the examples and techniques disclosed and claimed.

INDUSTRIAL APPLICABILITY

The present disclosure provides systems and methods for regulating down force on a work tool from a linkage of articulating arms controlled by a work machine, such as an excavator or a backhoe. Position and motion sensors and force sensors within the linkage provide data for a controller in the work machine to determine a location of the work tool and down force applied from the linkage onto the work tool during a job. Based on characteristics of the work tool, an acceptable range of down force applied by the linkage may be assigned. In some examples, if down force reaches an outer bound of the acceptable range during the job, the controller may generate an alert for the operator or adjust action by the work tool to maintain the down force within the acceptable range. Depending on the work tool and job, the down-force control can help improve work quality and guard against tool damage from dry-fire or overload conditions. In other examples, before performing a grading operation, an operator may request level control for the work tool at a benchmark orientation for the work tool and down-force control at a target down force. After a controller applies the target down force with the work tool at the benchmark orientation, an operator may traverse the work tool along a path radial to the work machine. While moving the work tool, the controller may adjust one or more forces on the linkage to also maintain the benchmark orientation and the target down force within acceptable values during the traversal of the work tool, leading to simpler functionality for the operator and more consistent work product.

As noted above with respect to FIGS. 1-7, an example system for regulating down force generally includes a work machine 100, a linkage 120, a work tool 180, and a controller 170. Linkage 120 includes position and motion sensors 204 and force sensors 202 to detect location and pressures (or forces) within a boom 122 and a stick 124 of the linkage, along with actuators 206 for causing movement of the boom and the stick. In regulating down force, the controller receives tool data indicative of characteristics of work tool 180 attached to linkage 120 and receives pressure data indicative of an acceptable range of down force delivered by linkage 120 on work tool 180 during a job. The operator commands the controller 170 to move the work tool, and the controller causes action by the work tool. Pressure or force sensors 202 provide sensor data indicative of forces on at least the boom, and controller 170 calculates down force on the work tool during the action. If the controller determines that the down force is at or outside an outer bound of the acceptable range, an alert is output through operator interface 106. Alternatively, or additionally, controller 170 may adjust action by work tool 180 to return the down force to within the acceptable range, possibly after a time delay.

In the examples of the present disclosure, the down-force control for work machine 100 provides additional leverage for an operator to control a work tool along a work surface. The acceptable range for down force, along with alerts to the operator and possible adjustment of the linkage, enables controller 170 to deliver improved work quality for work tools and jobs benefiting from an optimal range of down force, such as soil compaction. For tools having local power sources to cause high-energy movement, such as hammers and vibratory compactors, the disclosed methods can help avoid damage to the tool from dry-fire conditions either during operation or at startup. Additionally, when combined with other automated features in work machine 100, such as auto-leveling or tool orientation, the down-force control can ease the difficulty for an operator in balancing multiple behaviors for the work tool simultaneously. Accordingly, the disclosed systems and methods can improve work quality for tools controlled by a linkage, extend the life of work tools, and decrease operator requirements for controlling the work machine.

Unless explicitly excluded, the use of the singular to describe a component, structure, or operation does not exclude the use of plural such components, structures, or operations or their equivalents. As used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

Terms of approximation are meant to include ranges of values that do not change the function or result of the disclosed structure or process. For instance, the term "about" generally refers to a range of numeric values that one of skill in the art would consider equivalent to the recited numeric value or having the same function or result. Similarly, the antecedent "substantially" means largely, but not wholly, the same form, manner or degree, and the particular element will have a range of configurations as a person of ordinary skill in the art would consider as having the same function or result. As an example, "substantially orthogonal" need not be exactly 90 degrees but may also encompass slight variations of a few degrees based on the context.

While aspects of the present disclosure have been particularly shown and described with reference to the embodiments above, it will be understood by those skilled in the art that various additional embodiments may be contemplated by the modification of the disclosed systems and methods without departing from the spirit and scope of what is disclosed. Such embodiments should be understood to fall within the scope of the present disclosure as determined based upon the claims and any equivalents thereof.

What is claimed is:

1. A computer-implemented method, comprising:

receiving, by an electronic controller within a work machine, a request for level control of a work tool attached to a linkage of the work machine, the linkage including a boom pivotally joined to the work machine and a stick pivotally joined to the boom;

receiving a benchmark orientation for the work tool as part of the level control during a job performed at a height above ground;

receiving a request for down-force control on the work tool;

receiving a target down force for the work tool as part of the down-force control during the job;

in response to input from an operator, causing, by the linkage:

positioning of the work tool at an orientation relative to a work surface, and application of a down force in a downward direction on the work tool while the work tool is off the ground;

receiving, by the electronic controller and via an operator interface, one or more signals requesting movement of at least the stick along a radial path;

causing, in response to the one or more signals, movement of the stick along the radial path while the work tool is off the ground;

receiving, from one or more sensors within the linkage, sensor data indicative of the orientation of the work tool and the down force on the work tool during the movement;

determining that the orientation differs from the benchmark orientation;

adjusting, based at least in part on the sensor data, the orientation of the work tool to maintain compliance with the benchmark orientation;

determining that the down force while the work tool is off the ground differs from the target down force; and while maintaining compliance with the benchmark orientation, adjusting one or more forces applied by the linkage to change the down force in compliance with the target down force while the work tool is off the ground.

2. The computer-implemented method of claim 1, wherein maintaining the benchmark orientation for the work tool comprises:

receiving, from one or more position and motion sensors within the linkage, location data indicative of an angle of the work tool relative to the work surface during the movement; and modifying, based at least in part on the location data, a length of one or more of a boom actuator, a stick actuator, and a tool actuator during the movement of the stick to maintain an angle at the benchmark orientation for the work tool.

3. The computer-implemented method of claim 1, wherein adjusting the one or more forces applied by the linkage comprises causing at least a boom actuator to change position.

4. The computer-implemented method of claim 1, wherein the work tool is one of a mulcher or pallet forks.

5. The computer-implemented method of the computer-implemented method of wherein the work tool is a mulcher and the target down force corresponds with an acceptable feed rate for the work tool.

6. A control system within a work machine, comprising:

one or more actuators positioned to impart forces on arms of the work machine;

one or more sensors positioned within the arms, the one or more sensors being configured to detect positions of the arms and the forces on the arms;

a memory;

a controller communicatively coupled to the one or more actuators, the one or more sensors, and the memory, the controller configured to:

receive, from an operator interface within the work machine, a request for level control and a benchmark orientation for a work tool;

receive, from the operator interface, a request for force control and a target down force for the work tool;

cause the arms to apply a down force on the work tool at an orientation, the down force being in a downward direction on the work tool at a height above ground;

receive, from the operator interface, instructions to move the work tool along a path extending from the work machine and radially about a pivot joint of one of the arms;

cause movement of the work tool along the path while the work tool is off the ground;

receive, from the one or more sensors during the movement, sensor data indicative of the orientation of the work tool and the down force on the work tool during the movement;

determine that the orientation differs from the benchmark orientation;

adjust, based at least in part on the sensor data, an angle of the work tool to maintain compliance with the benchmark orientation;

determine that the down force on the work tool during the movement is different from the target down force; and while maintaining compliance with the benchmark orientation, adjust at least one of the forces on the arms to change the down force in compliance with the target down force while the work tool is off the ground.

7. The control system of claim 6, wherein the work tool is pallet forks and the target down force is an acceptable down force to avoid damaging tines for the work tool.

8. The control system of claim 6, wherein the controller is further configured to:

receive an identification of the work tool; and receive tool data indicative of characteristics for the work tool, the characteristics including dimensions and weight for the work tool.

9. The control system of claim 8, wherein the tool data includes a tool center-of-gravity.

10. The control system of claim 8, wherein the controller receives the identification of the work tool wirelessly from the work tool.

11. The control system of claim 6 wherein the work tool is a mulcher and the target down force corresponds with an acceptable feed rate for the work tool.

12. The control system of claim 6, wherein prior to receiving instructions to move the work tool along the path, the controller is further configured to:

cause the work tool to be placed in a starting location at the benchmark orientation; and cause the arms to apply the target down force on the work tool.

13. A work machine, comprising:

a linkage including a boom pivotally interconnected with a stick;

sensors, associated with the linkage, configured to detect positions and forces within the boom and the stick;

a work tool coupled to the stick;

an operator interface configured to receive inputs for controlling the work machine and to display outputs relating to operation of the work machine;

an electronic controller communicatively coupled to at least the sensors and the operator interface, the electronic controller configured to:

receive, from an operator interface within the work machine, one or more commands to cause motion by the work tool along a path extending from the work machine and radially about a pivot joint of the stick as part of a job performed at a height above ground;

cause, by the linkage, the motion by the work tool along the path while the work tool is off the ground;

receive, from the sensors within the linkage, sensor data indicative of forces on at least the boom and the stick during the motion;

adjust, based at least in part on the sensor data, a position of the work tool to have a level orientation;

calculate, at least in part from the sensor data, a down force on the work tool during the motion;

determine that the down force on the work tool during the motion is outside a down-force range; and while adjusting the work tool to have the level orientation, adjust the down force on the work tool to be within the down-force range while the work tool is off the ground.

14. The work machine of claim 13, wherein the electronic controller is further configured to:

receive an identification of the work tool; and receive tool data indicative of characteristics for the work tool, the characteristics including dimensions and weight for the work tool.

15. The work machine of claim 14, further comprising one or more actuators, associated with the linkage, configured to move the linkage and the work tool, the one or more actuators being one of hydraulic or electric.

16. The work machine of claim 14, wherein the work tool is pallet forks and the down-force range includes acceptable down forces to avoid damaging tines for the work tool.

17. The work machine of claim 6 wherein the level orientation corresponds with a tool angle to avoid spillage from the pallet forks.

18. The work machine of claim 14, wherein the work tool is a mulcher and the down-force range corresponds with an acceptable feed rate for the work tool.

19. The work machine of claim 13, wherein the electronic controller is further configured to:

receive, from the operator interface, a request for level control at the level orientation for the work tool and a request for down-force control within the down-force range.

20. The work machine of claim 19, wherein the request for level control includes the level orientation for the work tool during the motion along the path.

* * * * *